United States Patent [19]

Godwin, Jr.

[11] Patent Number: 4,709,426

[45] Date of Patent: Dec. 1, 1987

[54] MEANS FOR PRODUCING A WATER SPLASH SHIELD FOR COMMODES, URINALS OR THE LIKE

[76] Inventor: Oliver W. Godwin, Jr., Lakeshore Dr., Dunn, N.C. 28334

[21] Appl. No.: 582,055

[22] Filed: Feb. 21, 1984

Related U.S. Application Data

[63] Continuation of Ser. No. 92,490, Nov. 8, 1979, abandoned, which is a continuation-in-part of Ser. No. 16,188, Feb. 28, 1979, abandoned.

[51] Int. Cl.[4] ..... E03D 9/00; F15D 1/00

[52] U.S. Cl. ..... 4/300.3; 4/301; 4/311; 4/661; 4/DIG. 5

[58] Field of Search ..... 4/300, 300.3, 65 E, 4/609, 301, 311, DIG. 5, 144.1, 520, 420, 447, 448, 213, 42.4

[56] References Cited

U.S. PATENT DOCUMENTS

| | | | |
|---|---|---|---|
| 156,980 | 11/1874 | Burton | 4/DIG. 5 |
| 2,931,047 | 4/1960 | Stebbins | 4/300.3 |
| 3,425,066 | 2/1969 | Berger | 4/448 X |
| 3,486,172 | 12/1969 | Gleichert | 4/300.3 |
| 3,491,382 | 1/1970 | Poister | 4/213 |
| 3,869,737 | 3/1975 | Stevenson | 4/213 |
| 3,931,649 | 1/1976 | Jankowski | 4/DIG. 5 |
| 4,106,131 | 8/1978 | Delker | 4/420 X |

FOREIGN PATENT DOCUMENTS

| | | | |
|---|---|---|---|
| 281964 | 7/1913 | Fed. Rep. of Germany | 4/306 |

*Primary Examiner*—Henry K. Artis
*Attorney, Agent, or Firm*—Mills & Coats

[57] ABSTRACT

The present invention relates to a system for producing a water or fluid splatter shield across an open top area of a toilet bowl, urinal or the like. This is accomplished by supplying a fluid such as water or air under pressure to a nozzle, an annular ring type housing or pipe that is disposed about the top portion of the toilet bowl or urinal. Outlet means is formed about the interior of the nozzle, the annular ring housing or pipe such that fluid is dispersed therefrom and form a continuous, relatively thin sheet of flowing fluid above the bottom of the toilet bowl or urinal. Consequently, urine being directed into the toilet bowl or urinal is prevented from splattering out by the presence of the fluid shield.

16 Claims, 6 Drawing Figures

MEANS FOR PRODUCING A WATER SPLASH SHIELD FOR COMMODES, URINALS OR THE LIKE

This is a continuation of U.S. patent application Ser. No. 092,490, filed Nov. 8, 1979, now abandoned, which was a continuation-in-part of U.S. patent application Ser. No. 016,188, filed Feb. 28, 1979, now abandoned.

The present invention relates to water closets, urinals, and the like, and more particularly to a water splatter shield for use in conjunction with toilet bowls and urinals for preventing the urine from splattering out of the toilet bowl or urinal.

BACKGROUND OF THE INVENTION

In the course of urinating into a toilet bowl or urinal, it is not unusual for the urine to splatter out of the commode or urinal onto the surrounding walls and floor areas. This is especially so where the individual urinating is a male. Besides the odor and generally unsanitary conditions brought about, the urine damages the surrounding walls and floor giving rise to discoloration and causing paint, enamel and other surfaces to chip or peel.

This problem has been recognized in the past. For example, see U.S. Pat. Nos. 3,486,172; 2,931,047; 3,931,649; 156,980; and 4,106,131. Generally the problem of urine splatter has been dealt with by providing a structural splatter guard that is designed to be attachable to the top portion of a toilet bowl or urinal. For most part, structural splatter guards such as disclosed in U.S. Pats. Nos. 2,931,147 and 3,931,649, have not been really effective because they still leave the top of the toilet bowl or urinal open. In addition, such splatter guards are undesirable since they, like the toilet bowl, require cleaning periodically, and this is troublesome and inconvenient.

In U.S. Pat. No. 156,980, there is disclosed a very early urinal that illustrates flushing the urinal by directing a downward release of water. It is to be understood that this is for the purpose of flushing and cleaning the urinal. It does not function as a urine splatter shield, nor was it designed as such.

SUMMARY OF THE INVENTION

The present invention entails a toilet bowl or urinal having means associated therewith for selectively producing a water shield generally horizontally across the inlet top area of a commode or urinal. In one embodiment, the water shield produced extends above and over the bottom area of the commode or urinal such that urine directed into the commode or urinal must pass through the water shield. Consequently, the water shield serves as a urine splatter guard or shield since urine impinging on the water or upon the side wall structure of the commode or urinal cannot splatter back upwardly through the water shield and out the commode or urinal.

In a toilet bowl embodiment, the water splatter shield device of the present invention entails an annular ring type pipe that extends around the upper top portion of the commode, preferably adjacent the flush rim of the toilet bowl. For exhausting water out of the annular ring type conduit pipe, the same is provided with a continuous slit about the inside of the annular ring type conduit such that when water is supplied under pressure to the annular ring type pipe, it follows that the water is continuously exhausted or dispersed inwardly from conduit or pipe through the slit opening. The dispersed water from the annular ring type pipe forms a relatively thin water shield that extends generally horizontally across the top portion of the toilet bowl above the normal water level within the bottom of the toilet bowl.

In another embodiment, the water splatter shield device of the present invention includes a nozzle assembly disposed in the vicinity of the top opening of the commode or toilet bowl, and is adapted to emit a volume of water across the top of the commode in a shield like form. This effectively forms the urine splatter shield.

It is, therefore, an object of the present invention to provide a urine splatter guard for a commode or urinal that will prevent urine from splattering out of the commode or urinal onto the surrounding wall and floor area of a bathroom.

A further object of the present invention is to provide a device for forming a urine splatter shield or guard that requires little, if any, cleaning and which neatly adapts to the commode or urinal without physically or aesthetically encumbering the commode or urinal.

More particularly, it is an object of the present invention to provide a toilet bowl or urinal with means for selectively producing a fluid splatter shield such as a water or air shield, as compared to a purely physical splatter guard, about the toilet bowl or urinal for preventing urine from splattering out of the toilet bowl or urinal.

Another object of the present invention is to provide a water splatter shield of the character described above where the same is automatically actuated for a selected period of time.

Still a further object of the present invention is to provide a toilet bowl, urinal, or the like with means for producing a water splatter shield across the inlet area thereof that is relatively simple, inexpensive, easy to maintain, reliable and which can be added onto a conventional toilet bowl or urinal, or which can be integrally constructed therewith.

A further object of the present invention is to provide a commode, urinal or toilet bowl with a device for producing a urine splatter shield in the form of a nozzle assembly wherein the nozzle assembly upon selective activation is adapted to emit a continuous shield of water across the top of the commode, urinal, or toilet bowl that tends to prevent the urine from splattering back upwardly through the shield of water and through the top opening of the commode, urinal or toilet bowl.

Other objects and advantages of the present invention will become apparent from a study of the following description and the accompanying drawings where are merely illustrative of the present invention.

DESCRIPTION OF PREFERRED EMBODIMENTS

Figure 1:
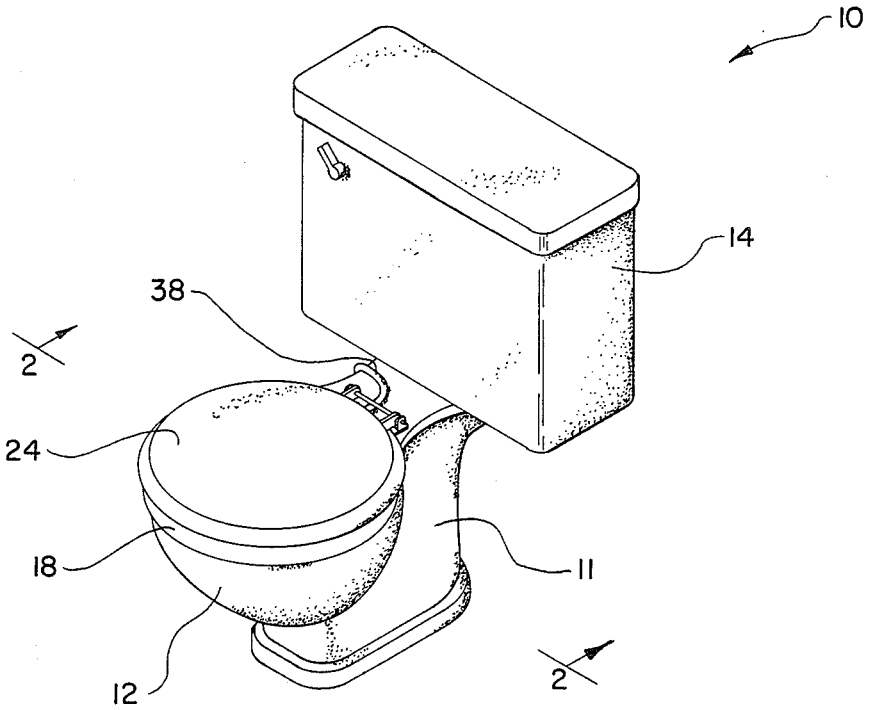
FIG. 1 is a perspective view of a water closet having the water splatter shield of the present invention incorporated therein.
Figure 2:
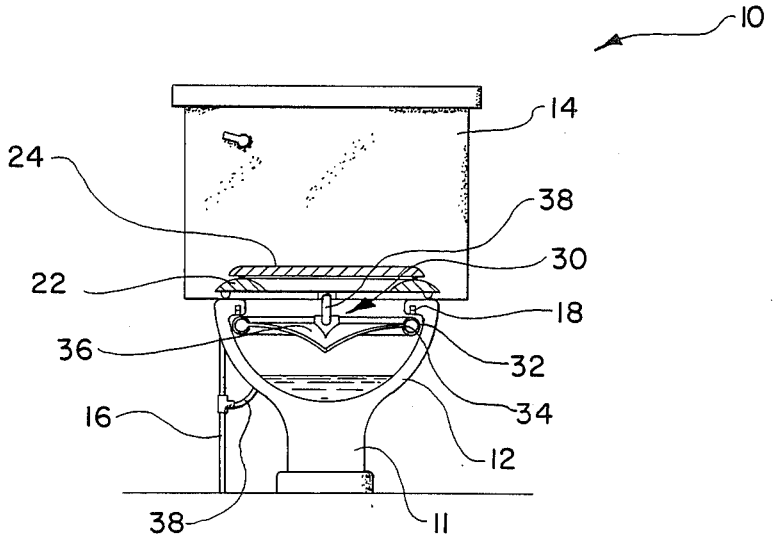
FIG. 2 is a sectional view taken along the lines 2—2 of FIG. 1.
Figure 3:
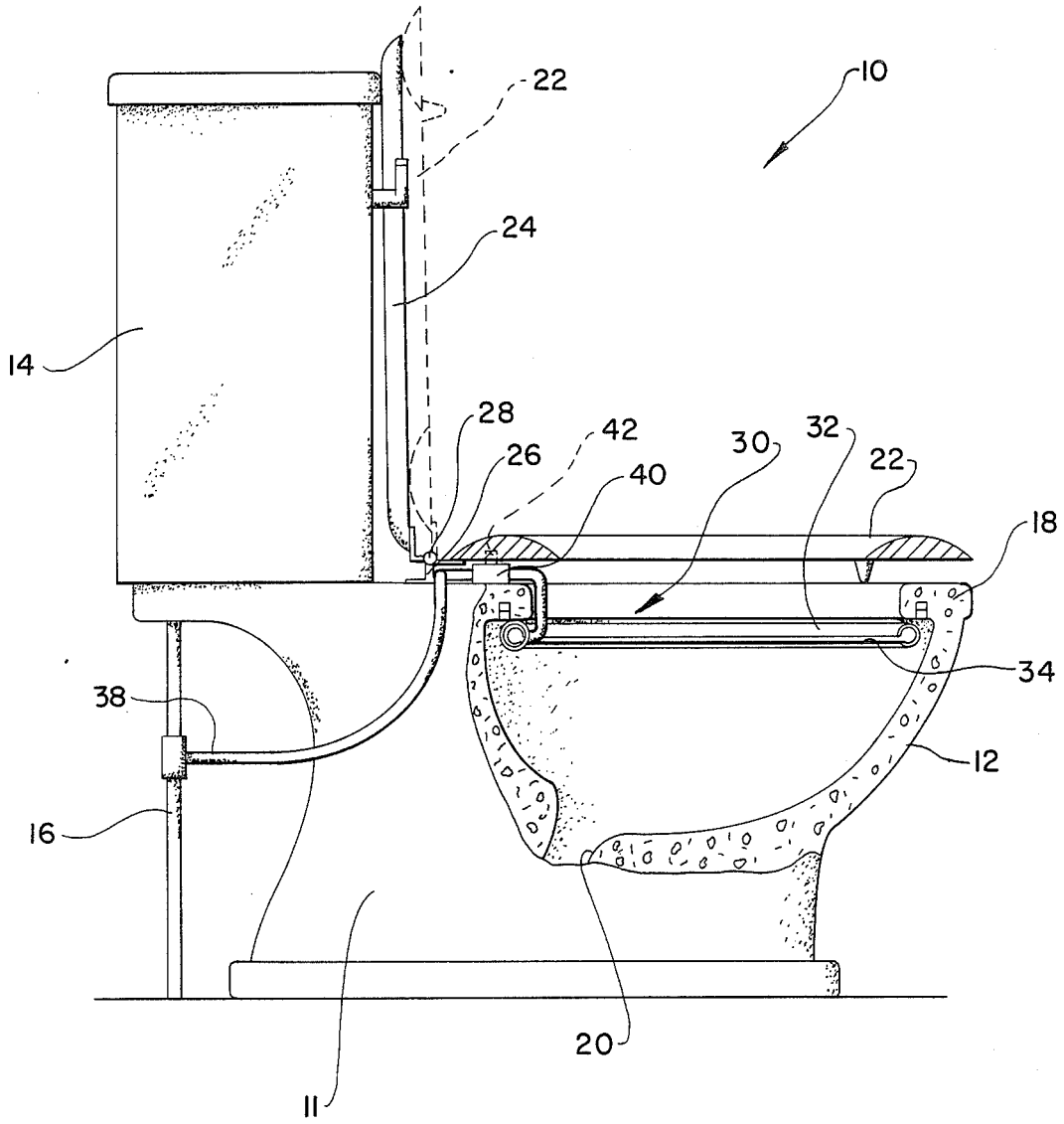
FIG. 3 is an enlarged side elevational view of the water closet of FIGS. 1 and 2 with a portion of the toilet bowl and seat shown in section to better illustrate the present invention.

With further reference to the drawings, particularly FIGS. 1 through 3, a water closet is shown therein and indicated generally by the numeral 10. Water closet 10 basically comprises a base portion 11 that has a toilet bowl 12 integrally formed therewith, and wherein the water closet 10 further includes a tank portion 14. Details of the tank portion 14, the plumbing and controls therein, and the flush system is not dealt with herein in detail because such is not material per se to the present invention and further because such is conventional and well appreciated in the prior art. However, as illustrated in FIGS. 2 and 3, there is shown a water inlet line 16 which is directed to tank 14 and functions to direct water from a water source (not shown) to tank 14 of water closet 10.

Briefly reviewing toilet bowl 12, it is seen that the same includes a lower flush outlet 20 about the bottom thereof, and as seen in FIG. 2, the bottom of the toilet bowl 12 is adapted to normally contain a volume of water therein. A flush rim 18 surrounds the upper top portion of the toilet bowl 12 and as seen in FIGS. 2 and 3, the flush rim 18 projects inwardly from the side retaining wall structure of the toilet bowl 12.

Pivotably mounted just above and slightly rearwardly of the flush rim 18 is a seat 22 and a top 24, with both the seat 22 and top 24 being pivotably mounted to a bracket assembly 26 by a pivot pin 28.

The present invention particularly entails the provision of means for providing a water splash shield or guard about the open top inlet area of the toilet bowl 12. The means for producing water splash shield or guard means is referred to generally by the numeral 30 in the drawings.

Viewing the system of the present invention for producing the water splash shield, in the case of the embodiment illustrated in FIGS. 1 through 3, an annular pipe 32 is disposed about the upper area of the toilet bowl 12 just beneath the lower inwardly projecting edge of the flush rim 18. The annular pipe 32 in this embodiment extends entirely around the toilet bowl 12 and includes a continuous thin slit 34 formed about the inside area of the annular pipe 32. Thus, once water is directed into the annular pipe 32, under pressure, it is seen that water is exhausted or dispersed out the continuous slit opening 34 to form a continuous shield of water, indicated by numeral 36, interiorly within the bounds of the annular pipe or water receiving channel 32.

As shown in FIG. 2, it is seen that the water shield 36 is generally formed above the normal level of the water contained within the toilet bowl 12, and further that the water shield 36 extends generally horizontally across the open top area of the toilet bowl 12.

For supplying water to the annular pipe 32, an inlet water line 38 is teed into the water supply line 16 and routed generally upwardly therefrom to where the inlet line 38 is directed over the flush rim 18 about the rear edge of the toilet bowl 12, between the flush rim 18 and seat 22, to where the inlet water line 38 is teed into the annular pipe 32.

Operatively associated with the inlet water line 38 is a valve 40 that includes an actuator 42, that in the case of the present embodiment, is disposed and aligned such that the same is actuated by the movement of seat 22 from its normal horizontal position to an upright elevated position, shown in dotted lines in FIG. 3. Valve 40 could be of the type that is adapted to remain open a predetermined time after actuation, or in the alternative, valve 40 could simply be actuated on and off by moving the same 22 between its normal horizontal position and its elevated upright position.

It should be noted that annular pipe 32 could be mounted and held in place within the toilet bowl 12 by appropriate mounting means. Alternatively, the inlet water line 38 may be rigid enough to support the annular pipe 32 in a suspended posture.

Figure 4:
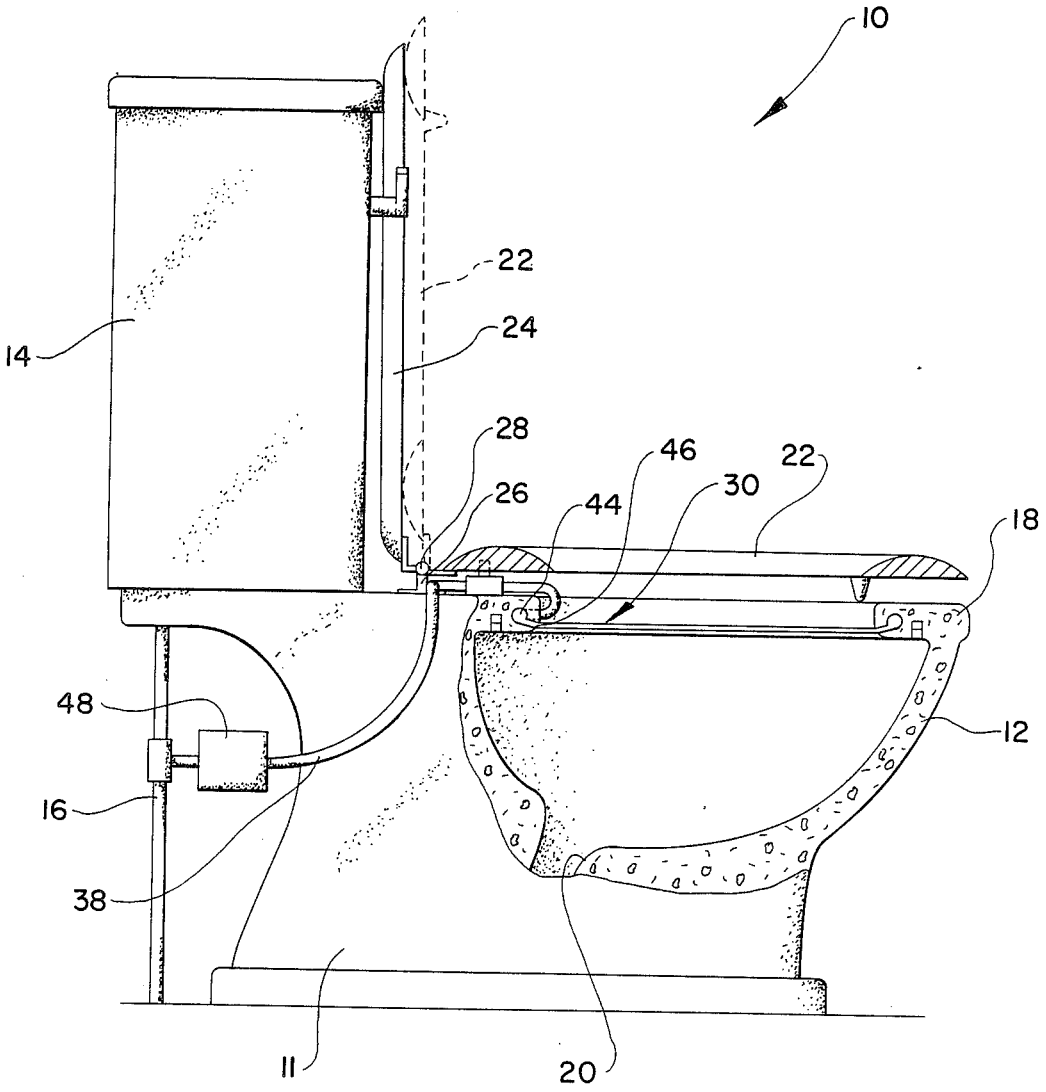
FIG. 4 is a side elevational view of a water closet, similar to FIG. 3, except that therein the device of the present invention for producing the water splatter shield is integrally constructed within the toilet bowl itself.

Turning to FIG. 4, a second embodiment of the present invention is illustrated, and in this case the system for producing the water splash shield is essentially the same as that described hereinabove, with the exception that the means for dispersing the water to form the water shield is integrally formed within the flush rim 18 of the toilet bowl 12. More particularly, as illustrated in FIG. 4, formed continuously around the flush rim 18 is an open annular water housing or receiving channel 44 that is adapted to receive water through inlet line 38. The annular housing or receiving channel 44 is open by a continuous outlet slit 46 that extends around the entire area of the flush rim 18. Consequently, as described hereinabove with respect to FIGS. 1 through 3, the selected actuation of valve 40 causes water to be directed from inlet line 38 into the annular housing 44 where the water is dispersed generally horizontally across the open top area of the toilet bowl 12 as the water is being dispersed or exhausted out a continuous slit 46 around the entire flush rim 18.

Another alternative as illustrated in FIG. 4, and this deals with the provision of a booster pump 48 operatively connected within the inlet water line 38. In certain cases, the pressure of the water in line 16 might not be sufficient for producing the water splatter shielf of the present invention, and so, therefore, a booster pump 48 could be utilized to increase the pressure sufficiently enough to form the water splatter shield.

Figure 5:
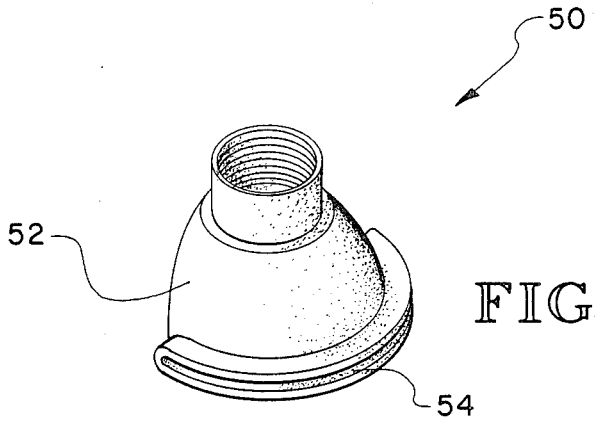
FIG. 5 is a perspective view of a nozzle or nozzle assembly of another embodiment for producing a urine splatter shield.
Figure 6:
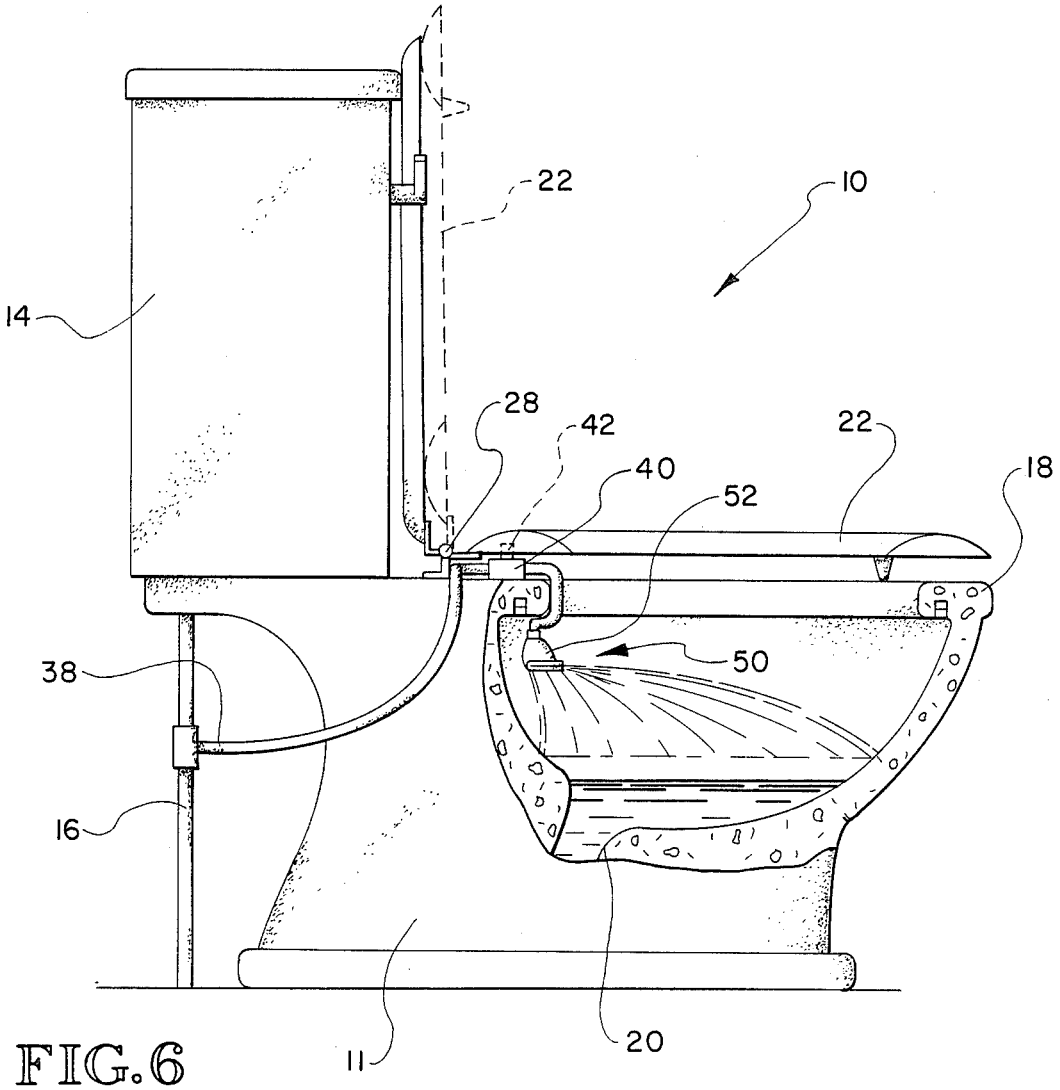
FIG. 6 is a side view, partially in section, illustrating the nozzle assembly mounted within a commode.

Another embodiment of the urine splatter shield device of the present invention comprises a nozzle assembly indicated generally by the numeral 50 and particularly illustrated in FIGS. 5 and 6. Nozzle assembly 50, as shown herein, is oriented about the rear top portion of the toilet bowl 12 and is designed and adapted to emit a shield of water across the open top of the commode or toilet bowl in like manner to the embodiments disclosed hereinabove.

Nozzle assembly 50 could even be integrally constructed with switch 40 from which the same may extend downwardly therefrom to a position adjacent the inner side of rim 18 of the commode.

Viewing the nozzle assembly 50 in more detail, it is seen that the same includes a housing structure 52 that is communicatively connected through valve 40 to a supply of water. Forming a part of nozzle assembly 50 is a nozzle lip type opening 54 that is designed so as to span in such a manner that when oriented in the top opening of the bowl 12 that the same is actuated to emit a shield of water across the open top portions of the bowl 12. Generally, it is contemplated that the nozzle opening 54 could be of a generally arcuate shape so as to emit a continuous volume of water across the open top of the bowl 12.

Since the nozzle assembly 50 is communicatively connected to the valve 40 that is actuated by the commode seat 22, it is appreciated that the raising of the commode seat 22 from its horizontal position to its upward vertical position results in the valve 40 being open and consequently water being dispersed out of the nozzle opening 54.

Once actuated, the nozzle assembly 50 serves the same basic function as the other embodiments discussed hereinabove. This function is to emit a thin shield of water, in a continuous spray, across the top opening of the toilet bowl 12. This continuous spray or shield of water prohibits the urine from splattering from the bottom of the bowl 12 upwardly through the top opening and on to the surrounding floor and walls around the water closet 10.

The above discussion has dealt with producing a water splatter shield for a toilet bowl. But it is understood and appreciated that the very same means could be utilized on conjunction with a urinal or other type of urine receptacle for forming a water shield about the inlet area of the same. The principal requirement for an effective system is that the water shield be such that urine directed into the toilet bowl or the urinal be constrained to pass through the water splatter shield, and that the water splatter shield be oriented with respect to the toilet bowl 12 or the urinal such that any urine tending to splatter will be directed back toward the water shield. It is appreciated that the presence of the continuous water shield, which is essentially a relatively thin sheet of water being continuously dispersed across a given area would act to intercept or prohibit urine from splattering out the toilet bowl or the urinal through the water shield.

The present invention further contemplates that the splatter shield could be formed by any other suitable fluid such as air. In the case of air, an air source would provide air under pressure that would be selectively directed to the annular ring housing 30 or nozzle 52 and dispersed out the opening 32 or 54 to form a generally horizontal air shield that would serve the same basic function as the water should discussed hereinabove.

From the foregoing discussion, it is seen that the present invention presents a very useful and effective means for preventing urine from splattering from a toilet bowl or a urinal onto surrounding walls or the surrounding floor area of a bathroom where such is located. The system of the present invention is effective, efficient, but yet is relatively simple, inexpensive, and easy to maintain as the same would not require cleaning in the same manner as would be required and expected with a purely structural splatter shield or guard.

The terms "upper", "lower", "forward", "rearward", etc., have been used herein merely for the convenience of the foregoing specification in the appended claims to describe the means for producing the water splash shield and its parts as oriented in the drawings. It is to be understood, however, that these terms are in no way limiting to the invention since the means for producing the water splash shield may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A sit down type water closet having a fluid urine splatter shield for preventing the splatter of urine, comprising a toilet bowl having a bottom that normally contains a volume of standing water having an upper surface, a side containing wall structure, and an opening formed about the top of said toilet bowl overlying said standing water, an outlet for urine and flush water to exit said toilet bowl, and a fluid urine splatter shield producing apparatus operatively associated with said water closet and toilet bowl for generating a generally horizontal sheet-like continuous shield of water between said toilet bowl opening and the upper surface of said standing water for preventing urine from splattering back upwardly from said standing water and out of said toilet bowl, said fluid urine splatter shield apparatus including an inlet fluid line communicatively connected to a fluid source; means communicatively connected to said fluid line for forming a fluid urine splatter shield between said toilet bowl opening and the upper surface of said standing water contained within the bottom of said toilet bowl, said means for forming said fluid urine splatter shield being disposed within said toilet bowl and extending at least partially around the opening intermediate the opening therein and the upper surface of said standing water and including means for spraying a generally horizontal sheet of water over and above the upper surface of said standing water and wherein the generally horizontal water shield substantially covers the opening formed within said toilet bowl so as to prevent urine from splattering back upwardly from the surface of said standing water as the fluid from said urine splatter shield mixes with uring being directed downwardly through the opening of said toilet bowl wherein the fluid urine splatter shield itself acts to intercept urine splattering upwardly from the surface of said standing water when one is urinating into said toilet bowl; and valve means operatively interconnected between said source of fluid and said fluid urine splatter shield means for selectively directing fluid from said fluid source through said inlet fluid line into said urine splatter shield means for producing the fluid urine splatter shield while one is urinating in said toilet bowl.

2. The water closet and fluid urine splatter shield means thereof, of claim 1, wherein said means for producing said fluid urine splatter shield comprises: an inner water receiving channel that extends around a substantial inner portion of the toilet bowl above the bottom thereof, and wherein said water receiving channel is provided with outlet opening means about the inside area thereof for directing water therefrom to form a water splatter shield over and above the upper surface of said standing water.

3. The water closet and fluid urine splatter shield means thereof, of claim 2, wherein said water receiving channel includes an annular conduit disposed over the bottom of said toilet bowl, and wherein said outlet opening means is formed around substantially the entire area of said annular conduit such that once actuated water flows inwardly from the inside area of said annular conduit so as to form a continuous water shield interiorly of said toilet bowl.

4. The water closet and fluid urine splatter shield means thereof, of claim 3, wherein said outlet opening means comprises a continuous slit formed substantially about the entire interior side portion of said annular conduit.

5. The water closet and fluid urine splatter shield means thereof, of claim 4, wherein said annular conduit is mounted interiorly of said toilet bowl generally overlying the bottom thereof.

6. The water closet and fluid urine splatter shield means thereof, of claim 4, wherein said annular conduit is integrally formed in the side wall structure of said toilet bowl so as to generally overlie the bottom thereof.

7. The water closet and fluid urine splatter shield means thereof, of claim 4, wherein said toilet bowl includes a seat movable between a horizontal position and a vertical position, and wherein said valve means is disposed with respect to said seat such that the same is actuated by moving the seat from its horizontal position to an elevated position.

8. In a water closet having a toilet bowl normally having a volume of standing water contained therein and including a bottom, an open top, a side retaining wall structure, an upper flush rim extending around the top portion of the toilet bowl, and a seat movably mounted between a horizontal position adjacent said upper flush rim and an elevated position; the improvement comprising means for producing a water splatter shield over and above said standing water and across the open top of said toilet bowl for preventing urine from splattering out of said toilet bowl; said means for producing the water splatter shield comprising: an inlet water line communicatively connected to a source of water; a water receiving channel communicatively connected to said inlet water line and disposed interiorly around said toilet bowl about and below the flush rim thereof but above the standing water within said toilet bowl; outlet water means formed within said water receiving channel for emitting water therefrom so as to form a water splatter shield across substantially the entire area of the open top area of said toilet bowl and above the standing water within said toilet bowl for preventing urine directed into the toilet bowl from splattering out; valve means communicatively connected between said water source and said water receiving channel for selectively directing water to said water receiving channel for forming the water splatter shield across the open top area of said toilet bowl.

9. The improved water closet of claim 8 wherein said water receiving channel comprises an annular ring type housing that generally encircles the open top of said toilet bowl, and wherein said outlet water means is formed continuously around the interior portion of said annular ring type housing such that water directed into said annular ring type housing is dispensed inwardly out said outlet water means so as to form a relatively thin water shield interiorly of said annular ring type housing.

10. The improved water closet of claim 9 wherein said annular ring type housing is in the form of a pipe that is disposed with respect to the toilet bowl such that it encircles the interior top portion thereof and is spaced relatively close to the side wall structure of said toilet bowl.

11. The improved water closet of claim 10 wherein said flush rim includes a ledge that projects inwardly from the interior side wall structure of said toilet bowl, and wherein said annular type ring housing in the form of said pipe is disposed generally underneath said ledge and extends substantially around the entire interior area of said toilet bowl.

12. The improved water clost of claim 9 wherein said annular type ring housing is integrally formed within the flush rim of said toilet bowl.

13. The improved water closet of claim 11 wherein said toilet bowl includes a seat movably mounted between a horizontal position where the same rests adjacent said flush rim and an elevated upright position; and wherein said valve means includes means for actuating the same in response to the movement of said seat member from said horizontal position to said elevated position, and wherein said valve means and said means for actuating the same is particularly positioned with respect to said seat member for accomplishing the actuation of said valve means in response to that movement of said seat member.

14. A method of controlling and preventing urine splatter by forming a fluid urine splatter shield in a toilet bowl having an open top, a bottom with standing water therein, a side retaining wall structure, and an outlet for urine and flush water to exit therefrom, for effectively allowing urine to enter the toilet bowl but which intercepts and prevents urine from splattering out of the toilet bowl, said method comprising the steps of: directing fluid from a fluid source to a control valve; selectively actuating said control valve and directing the fluid therethrough to a fluid dispenser extending at least partially around the open top, intermediate the open top and the standing water associated with said toilet bowl; directing fluid from said fluid dispenser so as to form a continuous, generally horizontal fluid shield over and above the standing water and the bottom of said toilet bowl, such that during the process of urination, urine directed into the toilet bowl passes through the form fluid splatter shield and wherein the presence of the fluid urine splatter shield acts to intercept and prevent urine from splattering upwardly through the fluid shield and out of the toilet bowl, and wherein the step of preventing urine splatter further includes the step of mixing the dispensed fluid that forms said splatter shield with urine being directed downwardly into the toilet bowl and wherein the dispensed fluid tends to combine with the urine and to carry and wash the same downwardly into the standing water of the toilet bowl.

15. The method of forming a fluid urine splatter shield of claim 14 wherein the step of actuating said control valve comprises the step of lifting a seat associated with said toilet bowl from a lower horizontal position to an elevated, generally vertical position.

16. The water closet and fluid urine splatter shield means thereof, of claim 1, wherein said toilet bowl includes a seat movable between a horizontal position and a vertical position, and wherein said valve means is disposed with respect to said seat such that the same is actuated by moving the seat from its horizontal position to an elevated position.

* * * * *